United States Patent [19]

Christmann et al.

[11] 4,450,124

[45] May 22, 1984

[54] PRODUCTION OF COMPACTED, LARGE-CALIBER EXPLOSIVE CHARGES

[75] Inventors: Wolfgang Christmann, Bergisch-Gladbach; Gerhard Lindner, Rosrath; Paul Lingens, Odenthal, all of Fed. Rep. of Germany

[73] Assignee: Dynamit Nobel Aktiengesellschaft, Troisdorf, Fed. Rep. of Germany

[21] Appl. No.: 98,947

[22] Filed: Nov. 30, 1979

[30] Foreign Application Priority Data

Dec. 4, 1978 [DE] Fed. Rep. of Germany ..... 2852334

[51] Int. Cl.[3] ..... C06B 21/00

[52] U.S. Cl. ..... 264/3 R; 86/1 R; 102/476

[58] Field of Search ..... 86/1 R; 102/24 HC, 476; 264/3 R

[56] References Cited

U.S. PATENT DOCUMENTS

| | | | |
|---|---|---|---|
| 3,027,838 | 4/1962 | Meddick | 102/24 HC |
| 3,034,393 | 5/1962 | Lieberman et al. | 102/24 HC |
| 3,255,659 | 6/1966 | Venghiattis | 102/24 HC |
| 3,736,875 | 6/1973 | Bucklishch | 102/24 HC |
| 3,907,947 | 9/1975 | Neuhaus et al. | 86/1 R |
| 3,924,510 | 12/1975 | Strunk et al. | 86/1 R |

OTHER PUBLICATIONS

Urbanski, Chemistry and Technology of Explosives, vol. 3, Pergamon Press, New York, 1967, pp. 235 to 240.

*Primary Examiner*—Edward A. Miller
*Attorney, Agent, or Firm*—Antonelli, Terry & Wands

[57] ABSTRACT

A process for producing a compacted large-caliber explosive charge, including a primary charge and a prefabricated propagation charge, involves compacting the primary charge and the propagation charge together within a casing, housing or the like structure.

3 Claims, No Drawings

PRODUCTION OF COMPACTED, LARGE-CALIBER EXPLOSIVE CHARGES

The invention relates to a process for producing compacted explosive charges, especially larger caliber charges with a primary charge and a prefabricated propagation charge.

It is known to manufacture large-caliber explosive charges by the casting method, wherein the explosive or the explosive mixture of the primary charge is cast into a casing. The recess for the propagation or booster charge is provided either by a displacement means or by subsequently drilling, milling, or the like. Large-caliber explosive charges are understood to mean those having a diameter of 60 mm. and above.

It is conventional from DOS [German Unexamined Laid-Open Application] 2,239,281 in connection with encased explosive charges to introduce the explosive of the primary charge as a bulk charge and/or as performed rough-compacted bodies into the casing and then compress such charge or bodies therein. In case of hollow charges below 50 mm., inert components, barriers, or the like, as well as hollow-charge inserts in the form of cones, hemispherical elements, or the like are simultaneously embedded therein. In these compacted, small- or medium-caliber explosive charges the recess for the propagation charge is produced by a corresponding configuration of the compressing tool during the compacting of the primary charge.

The propagation charge serves for transmitting the ignition impulse from the ignition arrangement, especially a detonator, to the primary charge and has a booster effect. Therefore, this charge is also called the "booster charge". This charge is prepared, separately from the primary charge in a special working step, from a suitable explosive and is provided with a varnish coat, a paper envelope, a thin aluminum sleeve, or the like to afford protection during handling and to avoid undesirable interactions with the primary charge, for example the formation of disadvantageous eutectic explosive mixtures.

The subsequent insertion and fixation of the propagation charge in the cast or compacted primary charge not only requires additional working steps but also is not devoid of danger and consequently entails special, voluminous safety measures. Furthermore, additional measures must be taken to ensure a gap-free contact of the propagation charge with the primary charge even under unfavorable circumstances. This gap-free transition from the propagation charge to the primary charge is important since gaps generally do not extend entirely regularly and thus impair the uniform transmission of the detonation and the efficiency of the explosive charge. In case of projectiles, especially those having a high muzzle velocity, it can happen, if there is a gap in the transition zone, that explosive particles are mutually displaced, or are shifted with respect to the casing of the explosive charge, on account of the strong acceleration forces during firing; this can be the cause of shells bursting within the barrel or bursting after having left the barrel.

The invention is based on the problem of avoiding these disadvantages in a process for producing compacted large caliber explosive charges, i.e. the object is to fashion the process, in particular, so that the manufacture of gap-free explosive charges is made possible at minimum expense without undesirable additional safety measures.

This problem has been solved according to the invention by compacting the primary or main charge and the propagation or primer charge together. Due to the combined compacting of the prefabricated propagation charge and the primary charge, a reliably gap-free contact is ensured between the two charges, and thus a so-to-speak shape-mating connection is established between these two charges which is flawless from the viewpoints of efficiency and safety. The additional operating steps and the special safety measures for the subsequent insertion and fixation of the propagation charge in the primary charge are eliminated. Preferably, the two charges are pressed directly into the casing of the explosive charge. However, it is also possible first to compact the two charges together in a matrix and thereafter to introduce them as a unitary formed body into the casing of the explosive charge. Optionally, a further, additional compacting of the formed body can take place in the casing. The prefabricated propagation charge is compressed to such an extent and is laterally supported in the casing or matrix to such a degree that it will withstand the full compacting pressure during the final compacting step and will not change its shape at all, or change it only in a defined fashion in that its height is, for example, slightly further reduced.

The explosive charges produced according to the process of this invention involve especially projectiles. However, the process can also be applied to the manufacture of warheads for rockets, of bombs, or the like. Preferably, the process is furthermore utilized for large-caliber bursting charges having an external casing diameter of at least 60 mm. and having been manufactured heretofore by expensive casting methods limited with regard to the explosives which could be processed thereby. However, basically, the process can also be used in small- or medium-caliber explosive charges.

The propagation charge made of an explosive such as tetryl, hexogen, penthrite, or the like is prefabricated in a separate working step so that a formed body is obtained which can be compacted according to the invention together with the primary charge. The primary charge is produced from a well compactable explosive, such as TNT, tetryl, hexogen, penthrite, or the like and associated, conventional desensitizers. The explosives or explosive mixtures of the two charges must be mutually compatible.

In a suitable embodiment of this invention, the provision is made to press the explosive of the propagation charge to be prefabricated into a rugged housing capable of completely absorbing the maximum pressure occurring during the combined compacting of the prefabricated propagation charge and the primary charge. This dimensionally firm housing can consist, for example, of metal, a ceramic material, a synthetic resin, or the like, having an appropriate wall thickness and configuration. Preferably the propagation charge is pressed into this housing in such a way that it does not alter its shape and density during the combined compacting with the primary charge.

The explosive of the primary charge to be compacted together with the prefabricated propagation charge can be present as a bulk charge. However, a mode of operation is preferred, wherein the primary charge is compacted in the form of one or more prefabricated rough-compacted bodies, optionally with the additional use of one or more bulk-type charge portions, together with the propagation charge. This compacting step can take place in one or several stages. To obtain a satisfactory mating of the shapes of the charges, it is generally advantageous to produce the rough-compacted body or bodies of the primary charge with a density lower than that of the finished explosive charge, so that the rough-compacted body or bodies are still further compressed by the final compacting procedure and are thereby placed in contact with one another and with the propagation charge without any gap formation in an especially simple manner. The final compacting with at least one rough-compacted body is preferred, since thereby the compacting tool can be maintained lower in its height. Additionally, a more uniform density is attained by the smaller compacting path.

In case of explosive charges, especially projectiles, it is required in certain usages to transmit the signal for the triggering of detonation from the front end of the explosive charge to the detonator arrangement disposed at the rear end. For this purpose an insulated, electric, wire-shaped conductor is preferably employed which extends along the outer surface of the primary charge in the longitudinal direction. According to a further suggestion, this conductor is, according to the invention, compacted together with the primary and propagation charges in an advantageous manner without there being any damage to the insulation of the conductor. Such damage must be avoided by reliable measures in order to prevent short circuits with an electrically conductive explosive charge casing. However, instead of providing an electric conductor, it is also possible, for example, to fashion the element extending in the longitudinal direction of the primary charge as a very thin tube into which the actual signal transmitter is threaded, for example, only after the final compacting step.

The process of this invention is conducted with presses of a conventional type of structure, such as hydraulic or eccentric presses which are remote-controlled for safety reasons. The compacting pressures utilized are determined conventionally in correspondence with the intended preliminary and/or final compacting of the explosive or explosive mixture present in an individual case. The combining of the primary charge and propagation charge in accordance with this invention by a single compacting step can take place in a matrix or directly in a permanent casing for the explosive charge. The process is especially advantageous for the production of large-caliber explosive charges, especially shells. In this case, the compacting of the charges can take place directly in the shell casing, so that simultaneously a shape-mating, gap-free junction is also obtained between the explosive charge and the shell casing. Thin-walled casings of the explosive charges are protected from deformations during the compression step by a press matrix.

BRIEF DESCRIPTION OF THE DRAWING

The process of this invention will be explained in greater detail below with reference to the drawing which is a schematic illustration of a hollow-charge projectile made in an embodiment of the invention process.

The single FIGURE shows a large-caliber hollow-charge projectile in a longitudinal section; the casing 1, made of steel appropriate for ordinance use, e.g. a chromium nickel steel, is provided at the front end with the ballistic head 2 and the detonation-triggering device 3 with a piezoelectric element 4. At the rear end, i.e. the bottom 5 of the projectile, the igniter 6 is arranged with the detonator 7. The piezoelectric element 4 and the igniter 6 are connected via the insulated electric conductor 8, shown in dot-dash lines; this conductor is disposed within the shell casing 1, i.e. in the charge chamber.

The propagation charge 9 is arranged following the igniter 6 toward the front and is supported toward the rear on the shoulder 10 of the projectile base 5. The prefabricated propagation charge 9 includes the dimensionally stable metallic housing 11 and explosive 12. The explosive of the propagation charge is pressed with its final density into the continuous, central recess in this metallic housing 11, the recess flaring conically toward the front. The metallic housing 11 is capable of absorbing the full compacting pressure during the combined compacting with the primary charge without any changes in the shape and density of the explosive 12 of the propagation charge 9. The primary charge consists essentially of the two prefabricated rough-compacted bodies 13 and 14.

In the preferred embodiment, the propagation or primer charge is pressed into its shape-retaining housing in such a way that in the common compression with the primary or main charge, the configuration and the density of the propagation charge will no longer be changed. In this case, in the common "compression" of the two charges, only the primary charge will be compacted and thereby intimately pressed against the propagation charge, so that a gap-free contact is ensured.

The prefabricated propagation charge 9 is pressed into the projectile casing 1 preferably by surrounding the propagation charge 9, which is centrally disposed on the rotationally symmetrical bottom 5 of the projectile, with the rough-compacted body 13 of the primary charge, which body has a corresponding recess, and by covering the propagation charge with the prefabricated explosive disk 15 formed of the same explosive as the prefabricated bodies 13 and 14. The inert element 16 is made of a plastic such as polyamide or polyehtylene or a metal such as aluminum and is arranged on the rough-compressed explosive disk 15. The propagation charge 9, the rough-compacted body 13, the explosive disk 15, and the inert element 16 are then compacted into a unit by a pressing step. This establishes in an advantageous manner the shape-mating joining of these components. This means that this portion of the charge is free of gaps, which is of special importance for the firm positioning of the propagation charge 9 in case of a projectile having a high muzzle velocity and correspondingly strong accelerative forces.

The further production of the hollow charge is accomplished by introducing the remaining, largest part of the primary charge as a rough-compacted body 14, together with the conical hollow-charge insert 17, into the projectile case 1 and then subsequently compressing this arrangement by means of a further pressing step with maximum compacting pressure, i.e. 1 to 2.5 kbar, especially 1.3 kbar. In this way, the arrangement is joined to the aforementioned, rough-compacted unit likewise without any formation of gaps. In this procedure, the annular space 18 above the inert element 16 has also been completely filled-in by explosive resulting from the rough-compacted bodies 13 and 14, which explosive has been pressed into this space. The hollow charge now exhibits its final density.

The insulated electric conductor 8 is previously incorporated by compacting, in that the rough-compacted bodies 13 and 14 are provided with a groove 19 and 20, respectively, extending in parallel to the longitudinal axis of the projectile, as indicated in dashed lines. The conductor 8 is placed in these grooves prior to the two compacting steps. The grooves can be worked mechanically into the rough-compacted bodies subsequently, but preferably they are produced directly during the manufacture of the rough-compacted bodies by an appropriate shape of the compacting tool.

The rough-compacted bodies 13 and 14 are not compressed to their final density during their manufacture so that a secondary compacting takes place during the combined compacting together with the propagation charge 9 within the projectile case 1, whereby the insulated conductor 8 is completely encompassed by explosive and is thereby reliably fixed in position. The use of rough-compacted bodies as compared with a bulk charge has the advantage that the insulated conductor, on account of the only slight secondary compacting during the final compacting step, cannot arrange itself in creases. Thereby, any buckling zones and any abrasion of the insulating material, which can result in ignition failures, are advantageously excluded.

It will be appreciated that the prefabricated propagation charge must comprise an explosive that is compatible with the primary charge. Moreover, this explosive must be readily ignited by the igniter charge. However, the propagation charge may consist of the same explosive as the primary charge, whereby adequate ignition sensitivity can be attained if, for example, the particle size of the explosive that serves as starting material for the propagation charge is finer than that of the chemically identical explosive of the primary charge. The required greater ignitability of the propagation charge can also be attained, for example, if the quantity of added desensitizing wax is less than in the primary charge.

The propagation charge 9 is pressed into metallic casing 11 with its final density, with a pressure of 1 to 2.5 kbar, especially 1.5 kbar. Charge 9, the precompression element 13, the explosive disk 15, and inert element 16 are compressed to a unit, by a compression process. The pressure then is 1 to 2.5 kbar, especially 1.3 kbar. The precompression element 13 and explosive disk 15 are prefabricated with a pressing pressure of 0.4 to 1 kbar, especially 0.7 kbar. Precompression element 14 is made similarly.

Pressing times, i.e. those times during which the explosive/explosives are exposed to full compression pressure, are between 2 and 20 seconds. In the embodiment described, the times are 5 s in compression at 0.7 kbar, and 10 s at pressure of 1.3 or 1.5 kbar.

What is claimed is:

1. A process for the production of compacted large-caliber explosive charges with a primary charge and a prefabricated booster charge, which comprises pressing the explosive of the booster charge into a dimensionally rigid housing so that the booster charge explosive withstands the maximum compacting pressure during subsequent combined compacting with the primary charge, forming the primary charge into at least one rough-compacted body and then further compacting the at least one rough-compacted body of the primary charge together with the explosive of the booster charge in the dimensionally rigid housing within a preformed casing.

2. A process according to claim 1, wherein together with the primary and booster charges, at least one element, extending along the primary charge and being fashioned as an elongated member, is compacted by using a rough-compacted body which has a recess accommodating the element, and the explosive of the rough-compacted body is pressed against the element during the compacting with the booster charge.

3. A process according to claim 1, wherein the booster charge is comprised of tetryl, hexogen, or penthrite.

* * * * *